US005094122A

United States Patent [19]

Okita

[11] Patent Number: 5,094,122

[45] Date of Patent: Mar. 10, 1992

[54] REMOTE CONTROL SYSTEM

[75] Inventor: Ryozo Okita, Hamamatsu, Japan

[73] Assignee: Sanshin Kogyo Kabushiki Kaisha, Japan

[21] Appl. No.: 644,925

[22] Filed: Jan. 23, 1991

[51] Int. Cl.[5] ..... G05G 11/00; F16H 21/44; B60K 41/00

[52] U.S. Cl. ..... 74/480 B; 74/109; 74/501.6; 340/686; 440/62; 440/87

[58] Field of Search ..... 74/109, 480 B, 501.6; 440/62, 84, 87

[56] References Cited

U.S. PATENT DOCUMENTS

| | | | |
|---|---|---|---|
| 856,288 | 6/1907 | Osborne | 74/109 |
| 2,702,615 | 2/1955 | Morse | 440/87 X |
| 2,869,861 | 1/1959 | Carlson | 74/109 X |
| 4,020,713 | 5/1977 | Cantley et al. | 74/480 B X |
| 4,527,983 | 7/1985 | Booth | 74/480 B X |
| 4,718,869 | 1/1988 | Fisher | 440/87 X |
| 4,836,809 | 6/1989 | Pelligrino | 440/87 X |
| 4,919,005 | 4/1990 | Schleicher | 74/501.6 |
| 4,920,819 | 5/1990 | Uchida et al. | 74/501.6 X |

*Primary Examiner*—Allan D. Herrmann
*Assistant Examiner*—David W. Laub
*Attorney, Agent, or Firm*—Ernest A. Beutler

[57] ABSTRACT

A remote control system is provided for transmitting control movement to a controlled member, such as a throttle or transmission control lever, on a marine propulsion unit from a selected one of a plurality of remote control units each of which has an operator movable between a plurality of positions. A remote control mechanism has at least one slidably supported control element operatively connected to each of the operators for linear reciprocation of the control elements upon movement of the respective operator. The remote control mechanism further includes a pinion gear operatively engaged with the control elements, a shaft connected for rotation with the pinion, and a pair of connecting links for converting the linear reciprocation of the control elements into a rotary motion of a spindle. A first rotation angle detecting device detects the rotational position of the spindle and transmits a signal to a control unit indicative of this rotational position. An actuator unit effects movement of the controlled member and is controlled by the control unit on the basis of the signal received from the first rotation angle detecting device. The invention may also include a second rotation angle detecting device for detecting the rotational position of a pinion gear of the actuator unit and transmitting a signal to the control unit indicative of this rotational position. When this additional detecting device is used, the actuator unit is controlled by the control unit on the basis of the signals received from both detecting devices to effect movement of the controlled member.

7 Claims, 3 Drawing Sheets

REMOTE CONTROL SYSTEM

BACKGROUND OF THE INVENTION

This invention relates to a remote control system which is adapted to be employed in connection with a marine propulsion unit, and more particularly to an improved remote control system of a type which includes two or more separate operators, either of which may be selectively operated so as to actuate a controlled member via an electric actuator unit and a detection/-control unit which utilizes a pair of rotation angle detecting devices, one for detecting the position of the operators and the other for detecting the position of the controlled member.

There are provided a number of types of remote control systems wherein two or more separately positioned operators may be employed to operate the same controlled member. For example, it is common practice on certain watercraft to have throttle/shift control operators both at the bridge and in the cabin of the watercraft. One type of remote control system has been proposed to reduce the operational load of the remote units particularly when they are incorporated in larger watercraft. This type of remote control system typically comprises two or more remote operators, a control mechanism to which the control cables are connected, an electric actuator to manipulate a controlled member on the propulsion unit, and a detection/control unit which employs straight-line type potentiometers to detect the positions of the control cables.

While this type of remote control system is generally satisfactory in reducing the operational load of the operators, it has certain disadvantages. For example, the construction of the system typically includes as many potentiometers as control cables which tends to make the system inordinately complicated. In addition, the use of straight-line type potentiometers makes waterproofing of the system difficult.

It is, therefore, a principal object of this invention to provide an improved remote control system which eliminates or reduces the above disadvantages.

It is a further object of this invention to provide an improved remote control system which employs two remotely located operators for actuating a controlled member and a pair of rotation angle detecting devices for detecting the position of the operator and the position of the controlled member respectively.

It is yet another object of this invention to provide an improved remote control system which employs two remotely located operators for actuating a controlled member and which reduces the operational load of the operators and which is constructed so that the system can be easily and satisfactorily sealed so as to resist water penetration.

SUMMARY OF THE INVENTION

This invention is adapted to be embodied in a remote control system for transmitting control movement to a controlled member which includes a plurality of remote control units each having an operator movable between a plurality of positions and a control unit. A remote control mechanism is provided which includes at least one slidably supported control element operatively connected to each of the operators for linear reciprocation of the control elements upon movement of the respective operator. The remote control mechanism further includes a spindle and means for converting the linear reciprocation of the control elements into a rotary motion of the spindle. In accordance with the invention, a first rotation angle detecting device detects the rotational position of the spindle and transmits a signal to the control unit indicative of this rotational position. The remote control system further comprises an actuator unit for effecting movement of the controlled member and which is controlled by the control unit on the basis of the signal received from the first rotation angle detecting device.

In accordance with a second feature of the invention, the actuator unit includes a pinion and a second rotation angle detecting device for detecting the rotational position of the pinion and transmitting a signal to the control unit indicative of this rotational position. The actuator unit is then controlled by the control unit on the basis of the signals received from the first and second rotation angle detecting devices to effect movement of the controlled member.

DETAILED DESCRIPTION OF THE PREFERRED EMBODIMENTS

Figure 1:
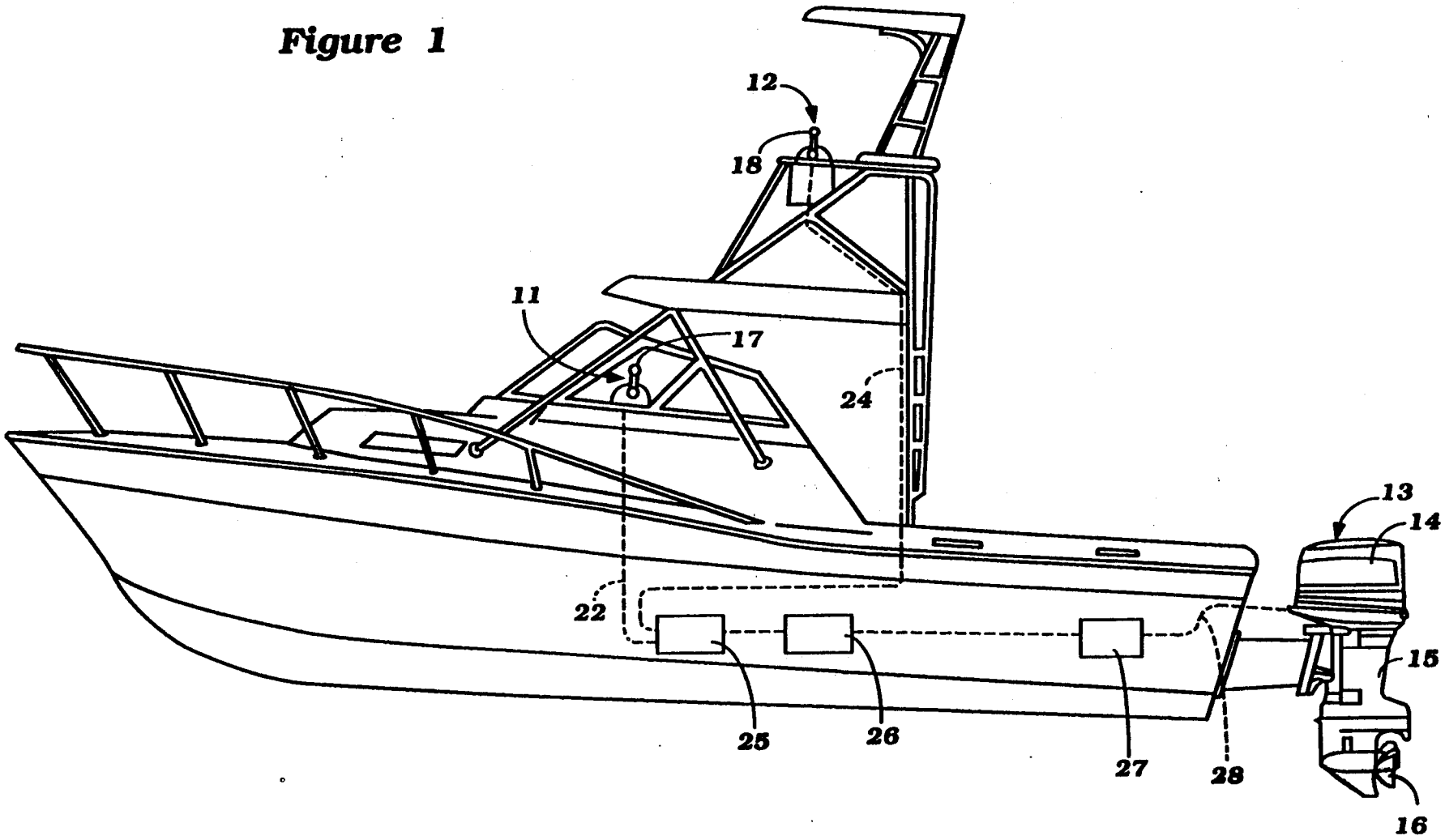
FIG. 1 is a partially perspective and partially schematic view of a remote control system constructed and operated in accordance with an embodiment of the invention.

Referring first to FIG. 1, a remote control system for operating a marine propulsion unit from either of two remote locations is depicted. One remote control unit, indicated generally by the reference numeral 11, is preferably located in the cabin and the other control unit, indicated generally by the reference numeral 12, is preferably positioned on the bridge of the watercraft, although other locations can be used. The remote control units 11 and 12 are provided for controlling a marine propulsion unit, identified generally by the reference numeral 13. The marine propulsion unit 13 may comprise either an outboard motor or the outboard drive portion of an inboard/outboard drive unit.

In the illustrated embodiment, the marine propulsion unit 13 includes a power head 14 that contains an internal combustion engine (not shown) and which is surrounded by a protective cowling. The internal combustion engine drives an output shaft which, in turn, drives a driveshaft that is journaled for rotation within a driveshaft housing 15 that depends from the power head 14. This driveshaft (not shown) drives a propeller 16 of a lower unit by means of a conventional forward, neutral, reverse transmission of the type used with such propulsion units. A transmission control lever is positioned on the marine propulsion unit 13 that is designed to operate this transmission. In addition, there is provided a throttle control lever that is adapted to control the speed of the powering internal combustion engine in a known manner. These transmission and throttle control levers or controlled members are actuated in a manner to be described.

Figure 2:
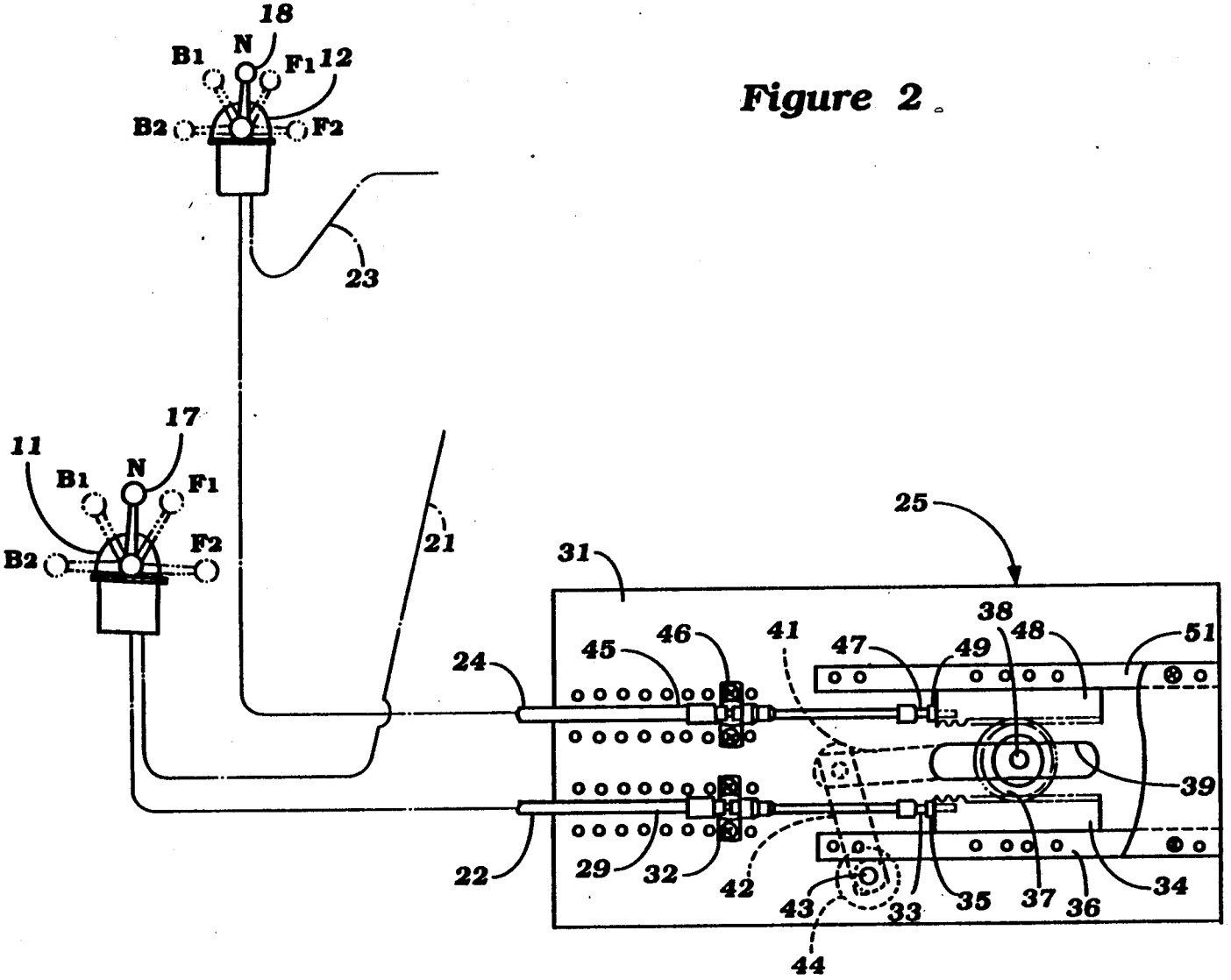
FIG. 2 is a partially schematic view showing the remote control units and their respective operators, and a side view of the remote control mechanism.

Referring now to FIG. 2, in addition to FIG. 1, each of the remote control units 11 and 12 is respectively comprised of a transmission-throttle control operator 17 or 18 respectively. The transmission-throttle control operators 17 and 18 are movable between a neutral position (N), as shown in solid lines in FIG. 2, and forward drive positions ($F_1$ and $F_2$) and reverse drive positions ($B_1$ and $B_2$), as shown in the phantom lines in FIG. 2. Positions $F_1$ and $B_1$ also correspond to partially opened throttle positions while $F_2$ and $B_2$ indicate a fully opened throttle position.

A bowden wire cable 21 is connected to the operator 17 for actuation of the transmission control lever, and a bowden wire cable 22 is connected to the operator 17 for actuation of the throttle control lever of the marine propulsion unit 13. In a like manner, a bowden wire actuator 23 is connected to the operator 18 for actuation of the transmission control lever, and a bowden wire 24 is connected to the operator 18 for actuation of the throttle control lever. The bowden wire cables 22 and 24 are connected to a remote control mechanism or joint unit, indicated generally by the reference numeral 25, that has means associated with it for transmitting an electrical signal to a detection control unit 26 which, in turn, transmits an electrical signal to an electric actuator unit 27 for actuation of the throttle control lever on the marine propulsion unit 13 via a throttle control bowden wire cable 28, in a manner to be described. Another remote control mechanism (not shown) is adapted for connection to the bowden wire cables 21 and 23 for actuation of the transmission control lever in a similar manner.

As shown in FIG. 2, the bowden wire 22 of operator 17 is slidably supported within an outer wire cover 29 that is affixed to a base 31 of the mechanism 25 by means of a mount 32. The bowden wire 22 is connected to a control rod 33 which is slidably supported within the mechanism 25 and which is connected to a first rack 34 by means of a coupling 35. The rack 34 is slidably supported on a first guide 36 and has teeth on its opposite surface that are enmeshed with a pinion gear 37 which is connected for rotation with a shaft 38 that extrudes from the rear of the of the base 31 through a slot 39. A first connecting link 41 is rotatably attached at one end to the shaft 38 and is pivotally connected at its opposite end to a second connecting link 42 so as to link the shaft 38 with a detection spindle 43. The spindle 43 is, in turn, rotatably supported at one end by a rotation angle detection device 44 on the rear side of the base 31.

In a similar manner, the bowden wire 24 associated with the operator 18 is slidably supported within an outer wire cover 45 that is affixed to the base 31 of the joint unit 25 by means of a mount 46. The wire 24 actuates a slidably movable control rod 47 which is connected to a second rack 48 by means of a coupling 49. The rack 48 is slidably supported on a second guide 51 and has rack teeth on its opposite surface that are engaged with the diametrically opposite side of the pinion gear 37.

As a result of these connections, the remote control mechanism 25 converts the linear reciprocations of the control cables 22 and 24 and slide racks 34 and 48 into the rotary motion of the detection spindle 43.

Figure 3:
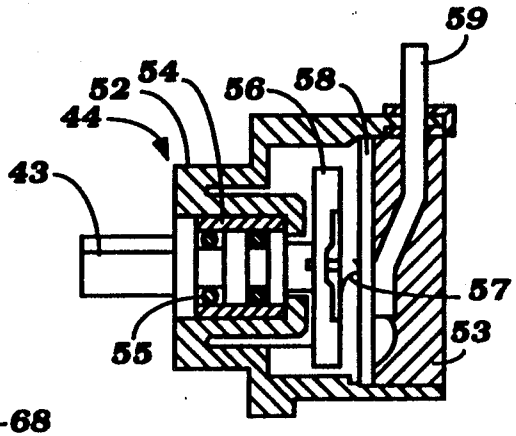
FIG. 3 is a cross sectional view showing one of the rotation angle detecting devices.

Referring now to FIG. 3, the details of the rotation angle detection device 44 are shown. In accordance with the invention, this rotation angle detection device 44 is constructed in the form of a rotary type potentiometer and includes an outer housing member 52 having a bore which extends from one end of the housing member 52 into a cavity within the housing 52. A cover member 53 closes off the cavity at the other end of the housing 52. A sleeve 54 is supported within this bore so that its inner end bears against a shoulder which forms a smaller diameter opening at the inner end of the bore. The detection spindle 43 is rotatably supported within a pair of 0-rings 55 which are positioned within the sleeve 54 and which act to seal around the detection spindle 43 and to prevent water from entering the interior of the detection device 44. A rotor 56 is positioned within the cavity of the housing 52 and is affixed to the inner end of the detection spindle 43. A flexible contact 57 is attached to the rotor 56 and is in slideable contact with a conductive plate 58. An input electrode or other means (not shown) is in circuit with the flexible contact 57 and an output electrode 59 of the rotation angle detection device 44 is connected to the detection/control unit 26 for transmitting an electrical signal. The point of contact on the plate 58 will vary depending on the rotational position of the rotor 56 which, in turn, will cause the resistance through the circuit to vary.

Figure 4:
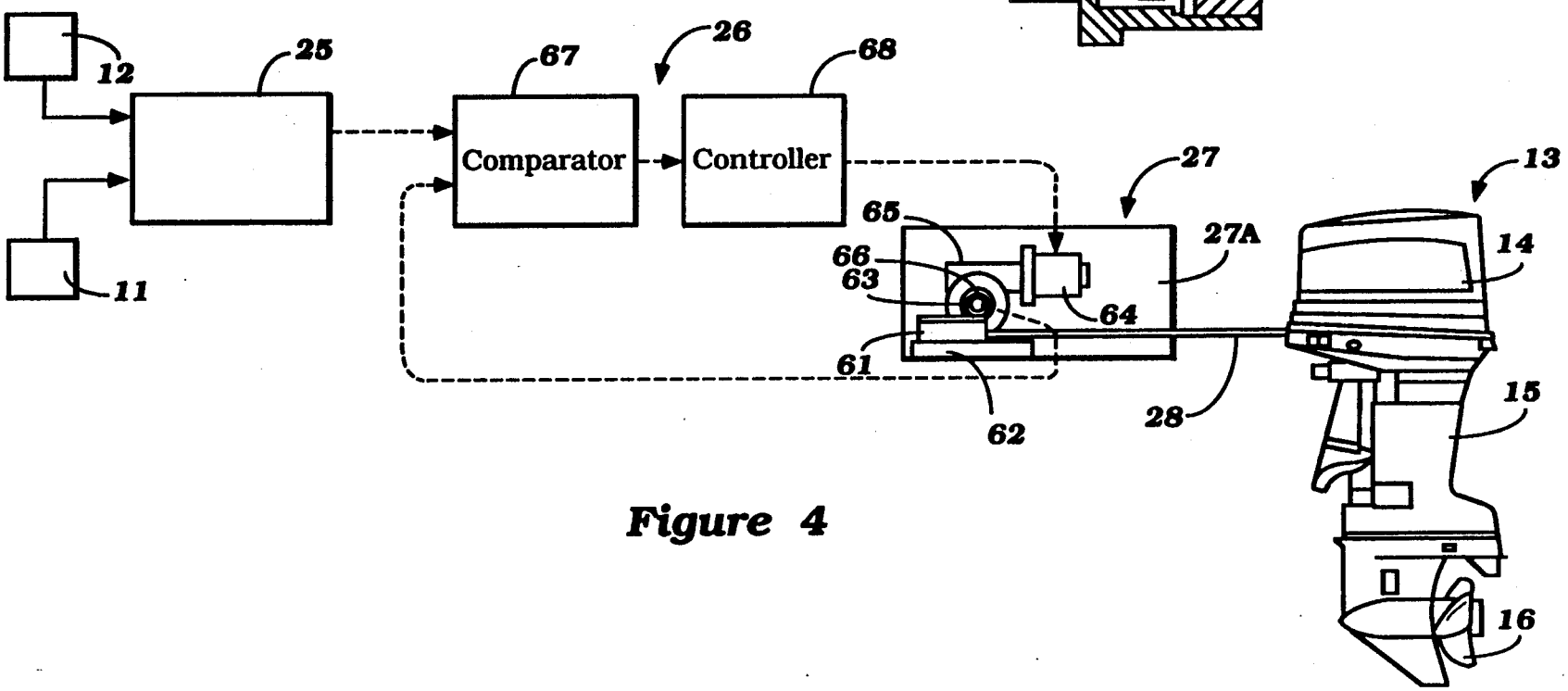
FIG. 4 is a partially perspective and partially schematic view of the remote control system including a block diagram showing the control scheme of the system.

Referring now to FIG. 4, it will be noted that the bowden wire cable 28 is connected at one end to the control lever on the marine propulsion unit 13 and extends through an aperture in a casing for connection at its other end to a slide rack 61 of the electric actuator unit 27. This slide rack 61 is slidably supported on a base 62 and has teeth on its opposite surface that are enmeshed with a pinion gear 63 which is rotatably journaled upon a driveshaft. An electric motor 64 is drivingly coupled to the driveshaft through a reduction gear box assembly 65 to effect movement of the control lever on the propulsion unit 13 based upon a signal received from the detection/control unit 26. A second rotation angle detection device 66 is linked with the pinion gear 63 and is adapted to detect the rotational position of the pinion gear 63 which corresponds to a particular position of the throttle control lever on the propulsion unit 13. The actuator unit 27 and its associated components are enclosed in a casing 27A.

The manner in which the remote control system operates to control the throttle lever on the marine propulsion unit 13 will now be described with particular reference to FIGS. 1, 2 and 4. When either of the operators 17 or 18 is moved from the neutral position to the $F_1$ or $B_1$ position, the bowden wire 22 or 24 will urge the rack 34 or 48 to the right (forward) or left (reverse), as viewed from FIG. 2. This will cause the pinion gear 37 and shaft 38 to rotate either clockwise (forward) or counterclockwise (reverse). The rotation of the shaft 38 is then transferred into the rotary motion of the detection spindle 43 by means of the connecting links 41 and 42. The rotation angle detection device 44 detects the rotational position of the spindle 43 which corresponds with the operated position of the operators 17 or 18 and transmits an electrical signal to a comparator 67 of the control unit 26 indicative of this spindle 43 position. The second rotation angle detecting device 66 detects the rotational position of the pinion gear 63 which corresponds with the position of the throttle control lever. An electrical signal is transmitted by this detection device 66 to a comparator 67 of the control unit 26 indicative of the pinion gear 63 position.

The comparator 67 compares the electrical signal outputs from the detection devices 44 and 66, and transmits a resulting electrical signal to a controller 68 of the control unit 26 which operates the motor 64 so that the position of the throttle lever on the marine propulsion unit 13 coincides with the position of the operator 17 or 18, which in this instance would be a partially open throttle position. If the operator 17 or 18 is moved from $F_1$ to $F_2$ or from $B_1$ to $B_2$ further movement of the throttle control lever will occur in the manner described above.

It should be noted that if the second rotation angle detecting device 66 is not used, the motor 64 will be controlled and operated by the control unit 26 on the basis of the electrical signal transmitted by the first rotation angle detecting device 44 only.

To actuate the transmission control lever of the marine propulsion unit 13, the bowden wire cables 21 and 23 effect movement of another remote control mechanism (not shown) but similiar to the mechanism previously described when either of the operators 17 or 18 is moved from the neutral position to either the $F_1$ or $B_1$ position. The remote control system for transmission control operates in a similiar manner to the remote control system for throttle control, except that in the former instance no actuation of the transmission control lever occurs when either of the operators 17 or 18 is moved between an $F_1$ and $F_2$ position or between a $B_1$ and $B_2$ position.

From the foregoing description it should be readily apparent that the described remote control system uses only one rotation angle detecting device 44 for detecting the operated positions of the operators 17 or 18. Moreover, since the rotation angle detecting devices 44 and 66 are of the rotary type rather than of the straight-line type, the devices 44 and 66 can be adequately sealed and waterproofed using only 0-rings 55. Although embodiments of the invention have been and illustrated and described, various changes and modifications may be made without departing from the spirit or scope of the invention, as defined by the appended claims.

I claim:

1. A remote control system for transmitting control movement to a controlled member comprising a plurality of remote control units each having an operator moveable between a plurality of positions, a control unit, a remote control mechanism including at least one slidably supported control element operatively connected to each of said operators for linear reciprocation of said control elements upon movement of the respective operator, said remote control mechanism further including a spindle and means for converting the linear reciprocation of said control elements into a rotary motion of said spindle, a first rotation angle detecting device for detecting the rotational position of said spindle and transmitting a signal to said control unit indicative of the rotational position of said spindle, said remote control system further comprising an actuator unit for effecting movement of said controlled member, said actuator unit being controlled by said control unit on the basis of the signal received from said first rotation angle detection device.

2. A remote control system as recited in claim 1, wherein said actuator unit comprises a pinion and a second rotation angle detection device for detecting the rotational position of said pinion and transmitting a signal to said control unit indicative of the rotational position of said pinion, and wherein said actuator unit is controlled by said control unit on the basis of the signals received from said first and second rotation angle detection devices.

3. A remote control system as recited in claim 2, wherein said control unit comprises means for comparing the signal transmitted by said first rotation angle detection device with the signal transmitted by said second rotation angle detection device, and means for transmitting a resulting signal to said actuator unit for effecting movement of said controlled member on the basis of the resulting signal.

4. A remote control system as recited in claim 1, wherein said first rotation angle detecting device comprises a rotor affixed to one end of said spindle, a flexible contact attached to said rotor and a conductive plate, said flexible contact being in slideable contact with said conductive plate.

5. A remote control system as recited in claim 4, wherein the point of contact of said flexible contact on said conductive plate varies depending on the rotational position of said rotor.

6. A remote control system as recited in claim 4, wherein said first rotation angle detecting device further comprises a housing having a bore in which said spindle is rotatably supported and sealing means positioned within said bore and around said spindle.

7. A remote control system as recited in claim 1, wherein said means for converting the linear reciprocation of said control elements into a rotary motion of said spindle comprises a pair of connecting links.

* * * * *